United States Patent [19]

Boyce, Jr. et al.

[11] 4,077,105

[45] Mar. 7, 1978

[54] VERTICAL FLANGE CLIP AND INSTALLATION TOOL

[75] Inventors: W. David Boyce, Jr., West Chester; Donald E. Kearns, Downingtown, both of Pa.

[73] Assignee: Ladd Tool Sales Co., Inc., West Chester, Pa.

[21] Appl. No.: 674,435

[22] Filed: Apr. 7, 1976

[51] Int. Cl.[2] ..... B25B 27/14

[52] U.S. Cl. ..... 29/278

[58] Field of Search ..... 29/278; 81/3 R; 52/484; 248/340, 317

[56] References Cited

U.S. PATENT DOCUMENTS

| | | | |
|---|---|---|---|
| 1,891,512 | 12/1932 | Venzie | 52/484 |
| 3,172,316 | 3/1965 | Grieshaber | 29/278 |
| 3,859,770 | 1/1975 | Chambers et al. | 52/484 |

*Primary Examiner*—James L. Jones, Jr

*Attorney, Agent, or Firm*—Caesar, Rivise, Bernstein & Cohen, Ltd.

[57] ABSTRACT

Vertical flange clip of spring steel or similar material comprises flat body portion with opposite open areas therein arranged to receive installation tool. Clip also has inverted U-shaped top portion integral with flat body portion, and gripping structure is provided on top portion for anchoring flange clip in place when inverted U-shaped portion thereof is forced onto elevated vertical flange structure. Installation tool has spaced apart fingers received into opposite open areas in flat body portion to hold and support clip during elevation thereof into place over vertical flange structure. Tool is then downwardly pulled to force U-shaped top portion of clip onto flange structure.

8 Claims, 7 Drawing Figures

VERTICAL FLANGE CLIP AND INSTALLATION TOOL

BACKGROUND OF THE INVENTION

The present invention relates to a flange clip and an installation tool therefor, and more particularly to a vertical flange clip and an installation tool for elevating the clip into place over vertical flange structure and anchoring it to that structure.

Prefabricated bar joists are commonly used in the construction of low cost buildings and the like. In many instances, it is desirable to suspend a ceiling from these bar joists. Ducts, pipes and other conduits may also be so suspended. In the case of a ceiling, installation requires the mounting of wires to the bar joists, and these wires are then used to support ceiling stringers at the desired ceiling elevation. As is well known, bar joists include vertical flange structure, and clips are utilized to anchor the stringer wires to the flange structure. One available clip is installed with a hammer rap, but such installation requires the worker to utilize a scaffold or ladder to reach the vertical flange structure of the bar joists. The use of scaffolding, ladders and the like is time consuming and therefore expensive. Hence, there is a real need for an installation procedure which enables the worker to remain at ground level during the anchoring of clips onto the elevated flange structure.

SUMMARY OF THE INVENTION

Accordingly, it is an object of the present invention to provide a vertical flange clip which is easy to manufacture and use, and which is capable of being installed at an elevated location by a worker located at floor level.

Another object of the present invention is to provide a tool for installing a vertical flange clip onto elevated vertical flange structure.

In accordance with the present invention, a vertical flange clip of spring steel or the like comprises a flat body portion with opposite open areas therein arranged to receive an installation tool. The clip has an inverted U-shaped top portion integral with the flat body portion, and gripping structure is provided on one of the legs of the inverted U-shaped portion for anchoring the vertical flange clip in place when the inverted U-shaped portion thereof is forced onto elevated vertical flange structure.

The opposite open areas may comprise a notch in each side of the flat body portion. Also, the gripping structure may comprise teeth struck from the inverted U-shaped top portion. Moreover, a wire may be secured to and extend from the flat body portion.

The vertical flange clip of the present invention is used in combination with a tool for installing a clip onto elevated vertical flange structure. This tool has a main section with a pair of spaced apart fingers extending outwardly and upwardly therefrom. A clip support is located between the fingers and extends upwardly therefrom. The fingers of the installation tool are received into the opposite open areas in the flat body portion of the clip, and the clip rests against the upright support. The installation tool is used to elevate the clip into place over vertical flange structure after which the tool is downwardly pulled to force the U-shaped top portion onto that structure.

Preferably, the fingers of the installation tool are downwardly curved at the free ends thereof. Moreover, the opposite open areas in the clip may comprise a notch in each side of the flat body portion with the spacing between the notches being approximately the same as the spacing between the fingers of the installation tool.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 1:
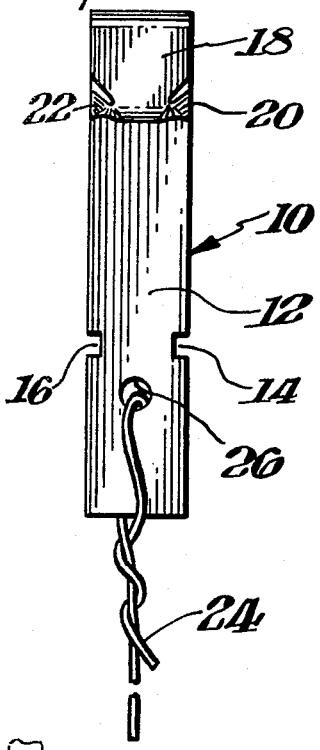
FIG. 1 is a front elevational view of a vertical flange clip, according to the present invention.
Figure 5:
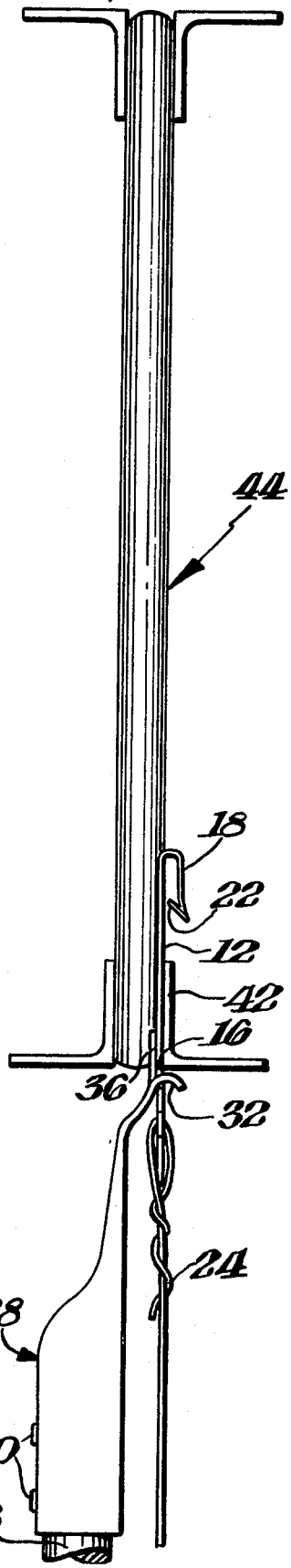
FIG. 5 is an elevational view illustrating installation of a vertical flange clip onto the elevated flange structure of a bar joist, according to the present invention.

Referring in more particularity to the drawing, FIG. 1 illustrates a vertical flange clip 10 fabricated from spring steel or similar material. The clip has a flat body portion 12 with opposite open areas 14, 16 therein arranged to receive an installation tool, as explained more fully below. Additionally, the vertical flange clip 10 includes an inverted U-shaped top portion 18 integral with the flat body portion 12. Gripping structure 20, 22 is provided on one of the legs of the inverted U-shaped top portion 18 for anchoring the vertical flange clip 10 in place when the inverted U-shaped portion thereof is forced onto elevated flange structure.

Figure 6:
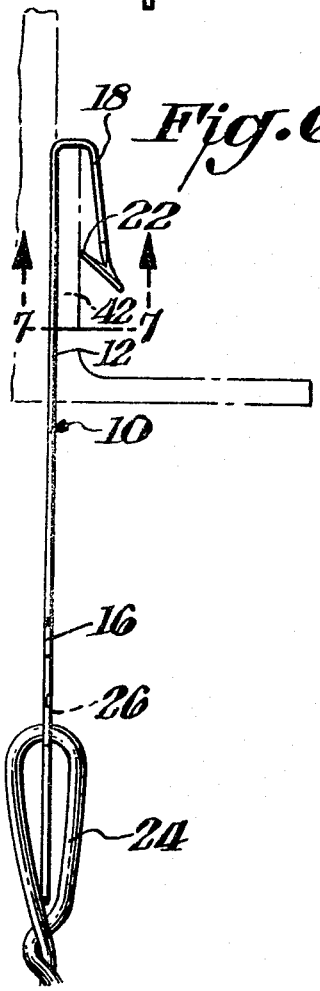
FIG. 6 is an enlarged elevational view illustrating the vertical flange clip anchored to the flange structure of a bar joist.

While other arrangements are available, it is preferred that the opposite open areas 14, 16 comprise a notch in each side of the flat body portion 12, as shown best in FIG. 1. Apertures (not shown) may be substituted for the notches. It is also preferred that the gripping structure 20, 22 comprise teeth struck from the inverted U-shaped top portion 18, as shown best in FIGS. 1 and 6. The teeth dig into the flange structure to which the clip 10 is secured to thereby anchor the clip thereto.

A wire 24 is secured to the flat body portion 12 by threading it through an aperture 26. The free end of the wire is then simply wrapped around the remaining wire to complete the fastening operation. In use, after the clip 10 is anchored in place, the wire 24 extending therefrom is used to suspend material from the elevated flange structure to which the clip is attached.

Figure 2:
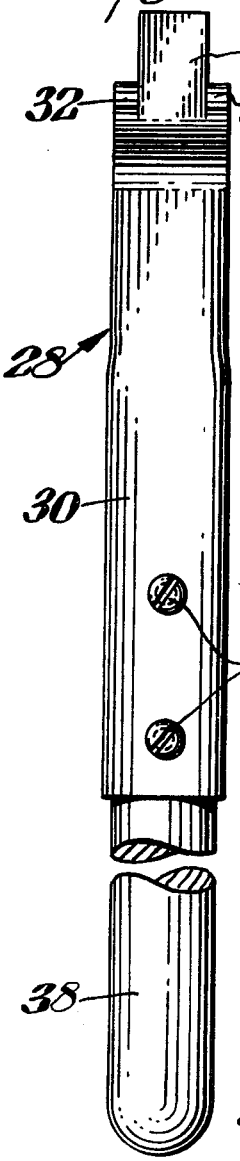
FIG. 2 is a back elevational view of an installation tool, according to the present invention.
Figure 3:
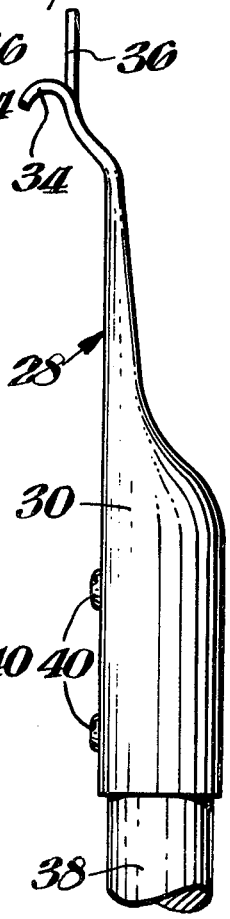
FIG. 3 is a side elevational view of the installation tool shown in FIG. 2.
Figure 4:
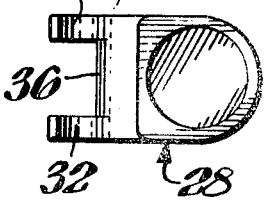
FIG. 4 is a bottom plan view of the installation tool shown in FIGS. 2 and 3.
Figure 7:
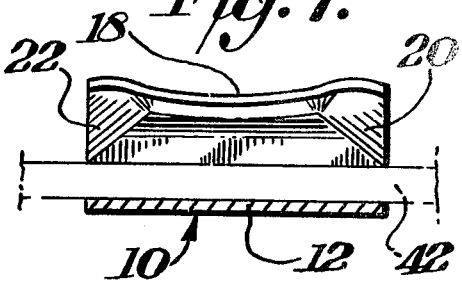
FIG. 7 is a sectional view taken along lines 7—7 of FIG. 6.

The vertical flange clip 10 is secured in place by utilizing an installation tool 28, as shown best in FIGS. 2–4. The installation tool includes a main section 30 with a pair of spaced apart clip holding fingers 32, 34 extending upwardly and outwardly therefrom. The tool 28 further includes an upright clip support 36 for holding and supporting the clip during the installation procedure, as explained more fully below. The clip support 36 is located between the fingers 32, 34 and extends upwardly therefrom. The main section 30 of the installation tool 28 is secured to a pole 38 by suitable fasteners 40. Alternatively, the upper end of the pole 38 may be externally threaded for mating engagement with internal threads on the lower end of the main section 30. The pole is dimensioned so that the main section 30 and the fingers reach the elevation at which the vertical flange clip 10 is secured in place.

For reasons explained more fully below, the transverse or lateral dimension of the upper portion of the main section 30 of the installation tool 28 including the spaced apart fingers 32, 34 is relatively small to facilitate insertion of those tool portions between closely spaced vertical flange structure should the need arise. Also, the free ends of the fingers 32, 34 are downwardly turned to facilitate placement of the clip when the pole 38 is pulled in a downward direction. The downturned ends of the fingers 32, 34 may be slightly curved to facilitate placement of the end of the tool in tight places.

The vertical flange clip 10 of the present invention is fastened in place onto vertical flange structure 42 as exists on a bar joist construction 44, for example. Initially, the fingers 32, 34 of the installation tool 28 are received into the opposite notches 14, 16 in the flat body portion 12 of the clip. The clip is thereby held and supported by the fingers 32, 34 and the flat body portion 12 of the clip rests against the upright clip support 36 of the installation tool. Generally, the clip is held and supported in an upright position by locating it in the crease formed by the fingers 32, 34 and the support 36. A worker at floor level then elevates the clip supporting end of the tool to a position where the inverted U-shaped portion 18 of the clip 10 is directly above the vertical flange 42. This is accomplished by using the pole 38. The worker then pulls the pole in a downward direction which forces the inverted U-shaped portion 18 onto the elevated vertical flange structure 42. The teeth 20, 22 engage the surface of the flange 42 as continued downward force is exerted by the worker. Ultimately, the bight section of the inverted U-shaped portion 18 engages the top of the flange 42 to complete the anchoring operation. The fingers 32, 33 are then removed from the secured clip 10 which frees the tool and makes it available for another clip installation. The relatively small width of the installation tool enables positioning thereof in very tight places, such as exist on bar joist constructions, for example.

The wires 24 extending from the installed clips 10 can then be utilized to suspend ceiling supporting stringers from the bar joists 44. Alternatively, the clip 10 and fastening structure such as the wire 24 may be used to hang pipes, ducts, conduits, and the like from the bar joist 44.

What is claimed is:

1. A vertical flange clip of spring steel or the like in combination with a tool for installing the clip onto elevated vertical flange structure, said vertical flange clip comprising a flat body portion with opposite open areas therein arranged to receive an installation tool, an inverted U-shaped top portion integral with the flat body position, and gripping structure on one of the legs of the inverted U-shaped top portion for anchoring the vertical flange clip in place when the inverted U-shaped portion thereof is forced onto elevated vertical flange structure, the installation tool having a main section with a pair of spaced apart fingers extending upwardly and outwardly therefrom, and clip support means located between the fingers and extending upwardly therefrom whereby the fingers of the installation tool are received into the opposite open areas in the flat body portion of the clip and the clip rests against the upright support means for elevating the clip into place over vertical flange structure after which the tool is downwardly pulled to force the U-shaped top portion of the clip onto that structure.

2. A combination as in claim 1 wherein the fingers are downwardly curved at the free ends thereof.

3. A combination as in claim 1 wherein the opposite open areas in the clip comprise a notch in each side of the flat body portion thereof, and the spacing between the notches is approximately the same as the spacing between the fingers of the installation tool.

4. In combination, a tool and a clip, said tool for installing said clip for supporting a suspended ceiling on a vertical flange by a worker standing on a floor, said tool comprising an elongated member for supporting said clip at an upper end of the tool, said tool including finger means which extends laterally from the axis of said elongated member for releasably securing the clip at the upper end of the tool, said tool also including an upright member which co-acts with said finger means to support said clip, said clip including a gripping structure and an open area for receiving said finger means, said elongated member enabling a worker to elevate said clip to said vertical flange, said finger means extending through and engaged with the horizontal edge of said clip in said opening for releasably securing said clip and enabling a force to be transmitted by said worker to force said gripping structure over said flange, said gripping structure acting to secure said clip to said flange when said gripping structure is forced over said flange, said means for releasably securing enabling said tool to release said clip after said clip is secured to said flange.

5. The combination of claim 4 wherein said clip includes an opening for receiving a wire which is preassembled on said clip so that said clip and said wire are secured to said vertical flange concurrently.

6. The combination of claim 4 wherein said gripping structure is formed as an inverted U-shaped section with at least one of the legs of said U-shaped section having at least one tooth which enables the U-shaped section to be forced over the edge of said flange but resists removal of the clip from said flange.

7. The combination of claim 4 wherein a pair of open areas are provided in said body for receipt of a pair of fingers provided on said elongated tool.

8. The combination of claim 7 wherein said open areas are provided at opposing lateral edges of said body and comprise notches in the lateral edges of said clip.

* * * * *